US007302981B2

(12) United States Patent
Benetton

(10) Patent No.: US 7,302,981 B2
(45) Date of Patent: Dec. 4, 2007

(54) APPARATUSES AND METHOD FOR DECORATING OBJECTS

(75) Inventor: Lorenzo Benetton, Illasi (IT)

(73) Assignee: V.I.V. International S.p.A., Cazzano di Tramigna (VR) (IT)

( * ) Notice: Subject to any disclaimer, the term of this patent is extended or adjusted under 35 U.S.C. 154(b) by 182 days.

(21) Appl. No.: 10/892,491

(22) Filed: Jul. 16, 2004

(65) Prior Publication Data

US 2005/0011614 A1 Jan. 20, 2005

(30) Foreign Application Priority Data

Jul. 17, 2003 (IT) ..... MO2003A0207

(51) Int. Cl.
*B32B 41/02* (2006.01)
*B32B 41/00* (2006.01)
*B32B 37/06* (2006.01)

(52) U.S. Cl. ..... 156/359; 156/497; 156/498; 156/499; 156/583.1

(58) Field of Classification Search ..... 156/359, 156/497, 498, 499, 583.1; 198/339.1
See application file for complete search history.

(56) References Cited

U.S. PATENT DOCUMENTS 5,893,964 A 4/1999 Claveau
6,221,189 B1 * 4/2001 Kieras et al. ..... 156/64
7,041,174 B2 * 5/2006 Carlson et al. ..... 118/695

OTHER PUBLICATIONS

European Search Report completed Feb. 16, 2006.

* cited by examiner

*Primary Examiner*—George Koch
(74) *Attorney, Agent, or Firm*—Nixon & Vanderhye P.C.

(57) ABSTRACT

An apparatus comprises a support arrangement for objects to be decorated, a valve device fixed to said support arrangement and provided with a shutter element actuatable for opening and/or closing a circuit traversable by a fluid from and/or to an enclosure arranged around said objects, wherein said shutter element is such as to be actuatable only when said support arrangement is in a preset configuration.

An apparatus comprises a frame, arranged to support objects to be decorated and associated with a carriage, wherein said frame and said carriage are configured as distinct units provided with a cooperating arrangement such as to enable said units to mutually couple and/or uncouple.

A method for measuring the temperature of objects to be decorated wrapped by an enclosure inside an oven comprises using a remote temperature gauge device.

A method for measuring the temperature of objects to be decorated wrapped by an enclosure inside an oven comprises using a laser thermometer device.

A method comprises sucking air from an enclosure wrapping objects to be decorated in a preparation station, taking groups of said objects from said preparation station in a transit station and taking up said groups from said transit station for conveying said groups to a heating station.

33 Claims, 10 Drawing Sheets

APPARATUSES AND METHOD FOR DECORATING OBJECTS

The invention relates to apparatuses and a method for decorating objects, in particular transferring a decoration to a profiled section by sublimation.

Apparatuses are known that enable a decorative pattern to be transferred by sublimation onto a profiled section from a sheet forming a tubular enclosure around the profiled section. Such apparatuses comprise two carriages alternately movable on guides between a preparation zone, in which the tubular enclosure is made to adhere to the profiled section, and a sublimation zone, in which the decorating pattern is transferred from the sheet to the profiled section by the combined action of pressure and heat.

Each carriage is provided with connectors, which are inserted into the open ends of each enclosure and are connected to suction device to suck air from each enclosure, thereby making it adhere to the profiled section by means of vacuum.

The sublimation zone is delimited by a chamber provided with a heat generator; in this chamber a thermocouple is insertable that measures the temperature of one of the profiled sections fixed to a carriage and as the temperature thereof reaches a sublimation value sends a cycle end message, after which that carriage is extracted from the sublimation zone.

Whilst one carriage is in the sublimation zone, the previously decorated profiled sections are unloaded from and the profiled sections to be decorated are loaded onto the other carriage. These operations are repeated cyclically on the two carriages, which are moved manually by pushing them towards or pulling them away from the sublimation zone.

One drawback of the known apparatuses is that they have modest productive capacity.

Furthermore, the known apparatuses have a high number of operators engaged in loading and unloading the carriages.

A further drawback is that when a carriage is extracted from the sublimation zone after the decorative pattern has been completed the carriage has a temperature that is near the temperature of the sublimation zone and is therefore very hot: this implies a certain risk for the operators.

A still further drawback is that the thermocouple must be positioned on a profiled section at the start of the cycle and must be removed from the profiled section at the end of the cycle, which causes a certain loss of time.

An object of the invention is to improve the apparatuses and methods for transferring an image from a support sheet to an object.

A further object is to improve the apparatuses and methods for obtaining greater productive capacity of the productive process of decorated objects through transfer of images from a support sheet.

A further object is to provide apparatuses and methods for decorating objects, thereby limiting the use of personnel.

A still further object is to increase the level of automation of apparatuses for the production of decorated objects so as to improve operator safety.

In a first aspect of the invention, there is provided apparatus comprising a support arrangement for objects to be decorated, a valve device fixed to said support arrangement and provided with a shutter element actuatable for opening and/or closing a circuit traversable by a fluid from and/or to an enclosure arranged around said objects, wherein said shutter element is such as to be actuatable only when said support arrangement is located in a preset configuration.

Owing to this aspect of the invention, a fluid can be sent to/or extracted from an enclosure without an operator intervening directly to actuate a valve device.

In a second aspect of the invention, there is provided apparatus comprising a conveying device, arranged to convey objects between a plurality of workstations, and a pneumatic operating system, intended to suck and/or blow a fluid from and/or to an enclosure wrapping said objects, wherein it furthermore comprises a drive device such as to actuate said conveying device between said plurality of stations.

Owing to this second aspect, it is possible to move the conveying device and with it the objects to be decorated, thereby limiting the number of operators involved.

Furthermore, it is possible to significantly increase the degree of automation of an apparatus, for example for the decoration of objects by image transfer.

In a third aspect of the invention, there is provided apparatus comprising a frame, arranged to support objects to be decorated and associated with a carriage, wherein said frame and said carriage are configured as distinct units provided with a cooperating arrangement such as to enable said units to mutually couple and/or uncouple.

Owing to the third aspect of the invention, it is possible to uncouple such distinct units to carry out proper operations on the frame and on the carriage and couple such distinct units when necessary. In particular, if it is necessary to heat the objects to be decorated, it is possible to heat-treat such objects, supported by the frame, without also having to heat the carriage, thereby significantly reducing the mass to heat and thus thermal power loss.

In a fourth aspect of the invention, there is provided a carriage arranged to support objects to be decorated, comprising a valve device provided with a shutter element actuatable to open and/or close a circuit traversable by a fluid from and/or to an enclosure arranged around said objects, wherein said shutter element is such as to be actuatable by a further valve device in a coupling configuration of said valve device with said further valve device.

According to a fifth aspect of the invention, there is provided a frame arranged to support objects to be decorated, comprising a valve device provided with a shutter element actuatable for opening and/or closing a circuit traversable by a fluid from and/or to an enclosure arranged around said objects, wherein said shutter element is such as to be actuatable by an activator element arranged on an apparatus distinct from said frame.

In a sixth aspect a method is provided comprising sucking air from an enclosure that wraps objects to be decorated in a preparation station, taking groups of said objects from said preparation station to a transit station and taking up said groups from said transit station to convey said groups to a heating station.

Owing to the sixth aspect it is possible, in each phase of the process, to operate on groups of objects, thereby increasing overall productive capacity.

In a seventh aspect of the invention there is provided use of a remote temperature gauge device to measure the temperature of objects to be decorated wrapped by an enclosure inside an oven.

In an eighth aspect of the invention there is provided use of a laser thermometer device to measure the temperature of objects to be decorated wrapped by an enclosure inside an oven.

Owing to the seventh and eighth aspects, it is possible to detect the temperature of the objects during the decorating phase without applying any device to them, thus limiting overall cycle time and simplifying operations preceding and following the decoration phase.

The invention may be better understood and carried out with reference to the attached drawings, which show some embodiments thereof by way of non-limiting example, in which.

Figure 1:
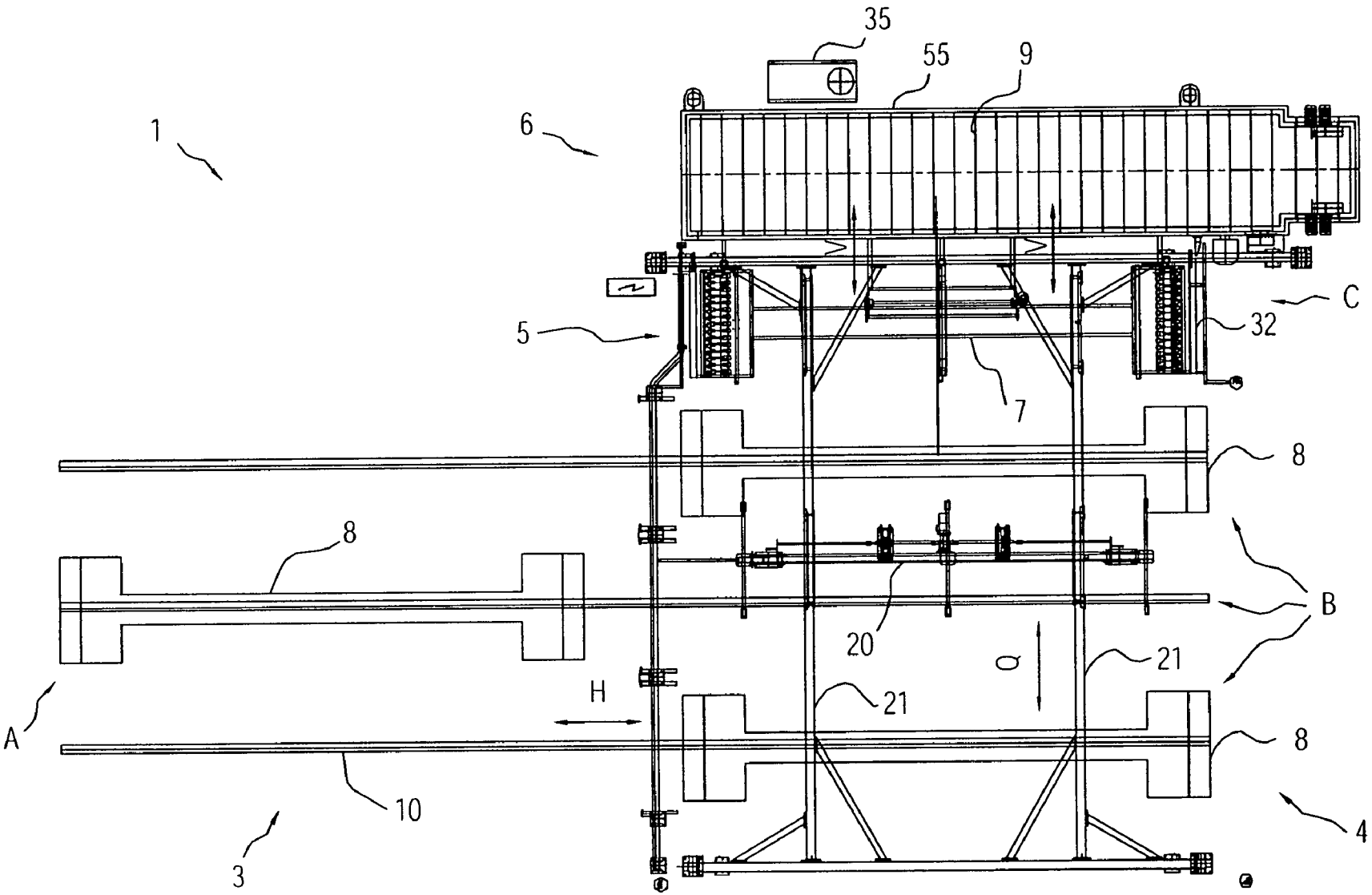
FIG. 1 is a plan view of an apparatus according to the invention.
Figure 2:
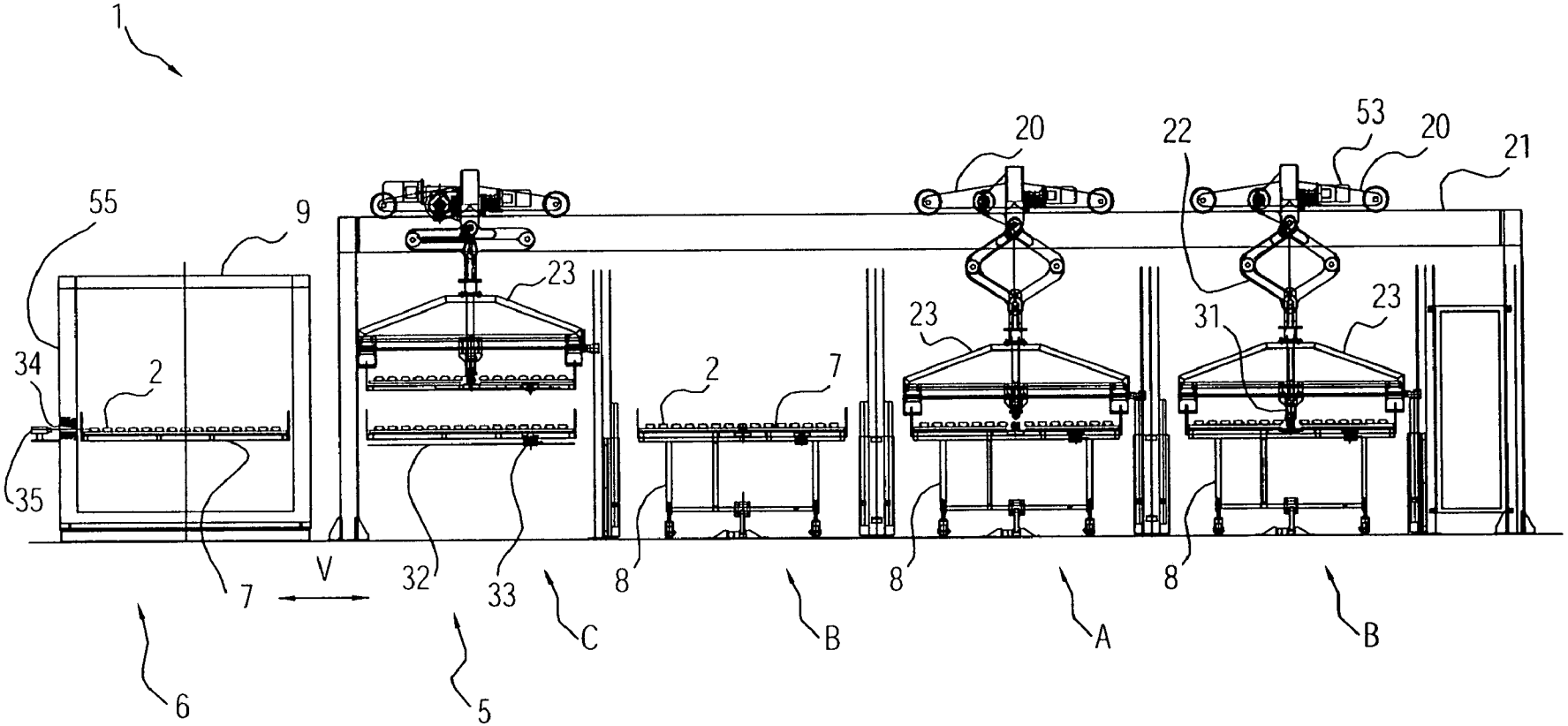
FIG. 2 is a schematic side view of the apparatus in FIG. 1.

FIGS. 1 and 2 show an apparatus 1 for decorating objects, in particular for decorating profiled sections 2, by transfer of an image from a sheet wrapping each profiled section 2 and having a decorative pattern of sublimable colours. The sheet is wrapped around the profile section 2 in such a way as to form an enclosure, which can be obtained and/or placed on the profiled section 2 in a suitable device upstream of the apparatus 1.

The apparatus 1 (FIG. 1) comprises a preparation station 3, in which the profiled sections 2 are prepared in such a way that from inside each enclosure that wraps each profiled section 2 air is sucked to enable the enclosure to adhere to surfaces of the profiled section 2. The apparatus 1 furthermore comprises a sublimation station 6, in which the profiled sections 2, wrapped in the enclosure, are inserted into an oven 9, in which the decorative pattern is transferred by sublimation from the sheet arranged as an enclosure to the profiled section 2. A transit station 4 is also provided in which the profiled sections 2 pause as they are moved along a path from the preparation station 3 to an interaction station 5 next to the oven 9 and vice versa. In the interaction station 5 the profiled sections 2 are loaded into the oven 9 and unloaded therefrom.

In the preparation station 3 carriages 8 are provided, for example three carriages, movable on guides 10 between a position A inside the preparation station 3 and a position B inside the transit station 4, according to a direction indicated by the arrows H in FIG. 1.

Figure 3:
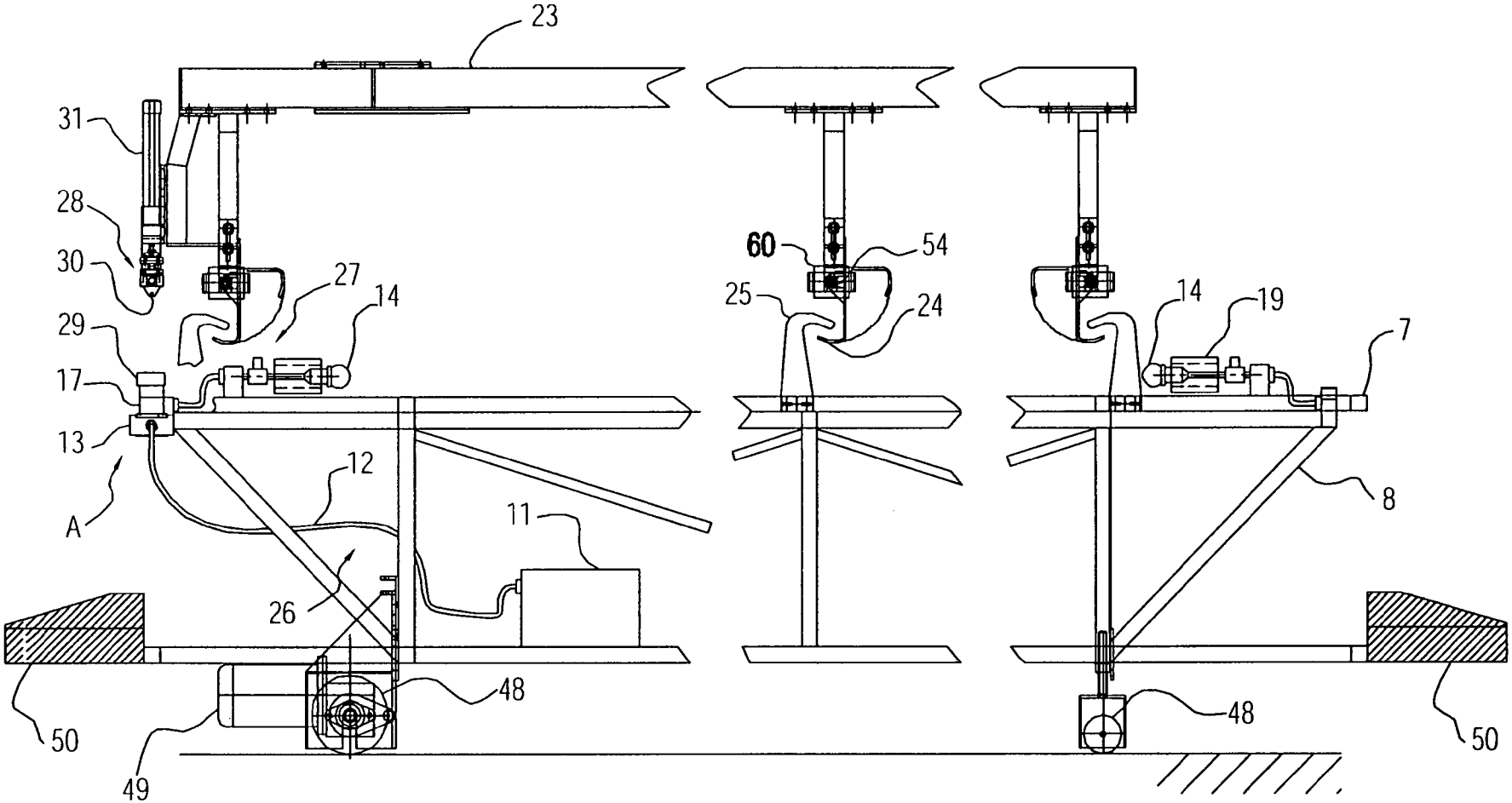
FIG. 3 is a front view of three apparatuses according to the invention.
Figure 4:
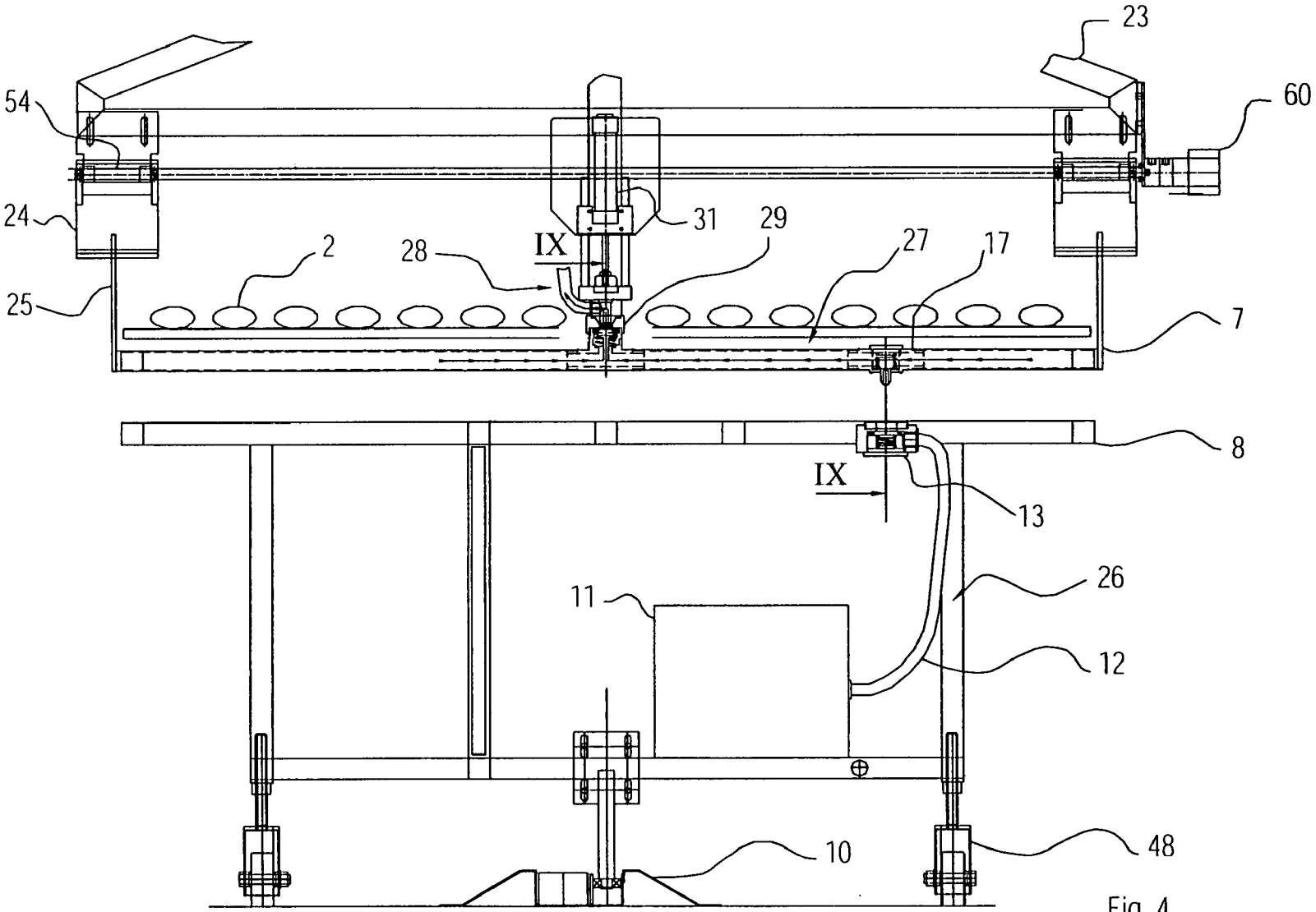
FIG. 4 is a side view of the apparatuses in FIG. 3 in a conveying configuration.

In FIGS. 3 and 4, each carriage 8 is provided with wheels 48 that are actuatable by an electric motor 49 through suitable transmission members, and safety elements 50 arranged to limit the risk that an operator or another apparatus may interfere with the carriage 8 during its movement.

Each carriage 8 furthermore comprises a suction device 26 provided with a vacuum pump 11, fitted to the carriage 8, connected by a hose 12 to a first valve 13 fixed to the carriage 8.

When each carriage 8 is situated in position A (FIG. 1), another apparatus is coupled with each carriage 8, for example a frame 7 (FIGS. 3 and 4) arranged to rest on the carriage 8 and on which a certain number of profiled sections 2 can be arrayed, for example fifteen profiled sections, each wrapped in an enclosure.

Figure 5:
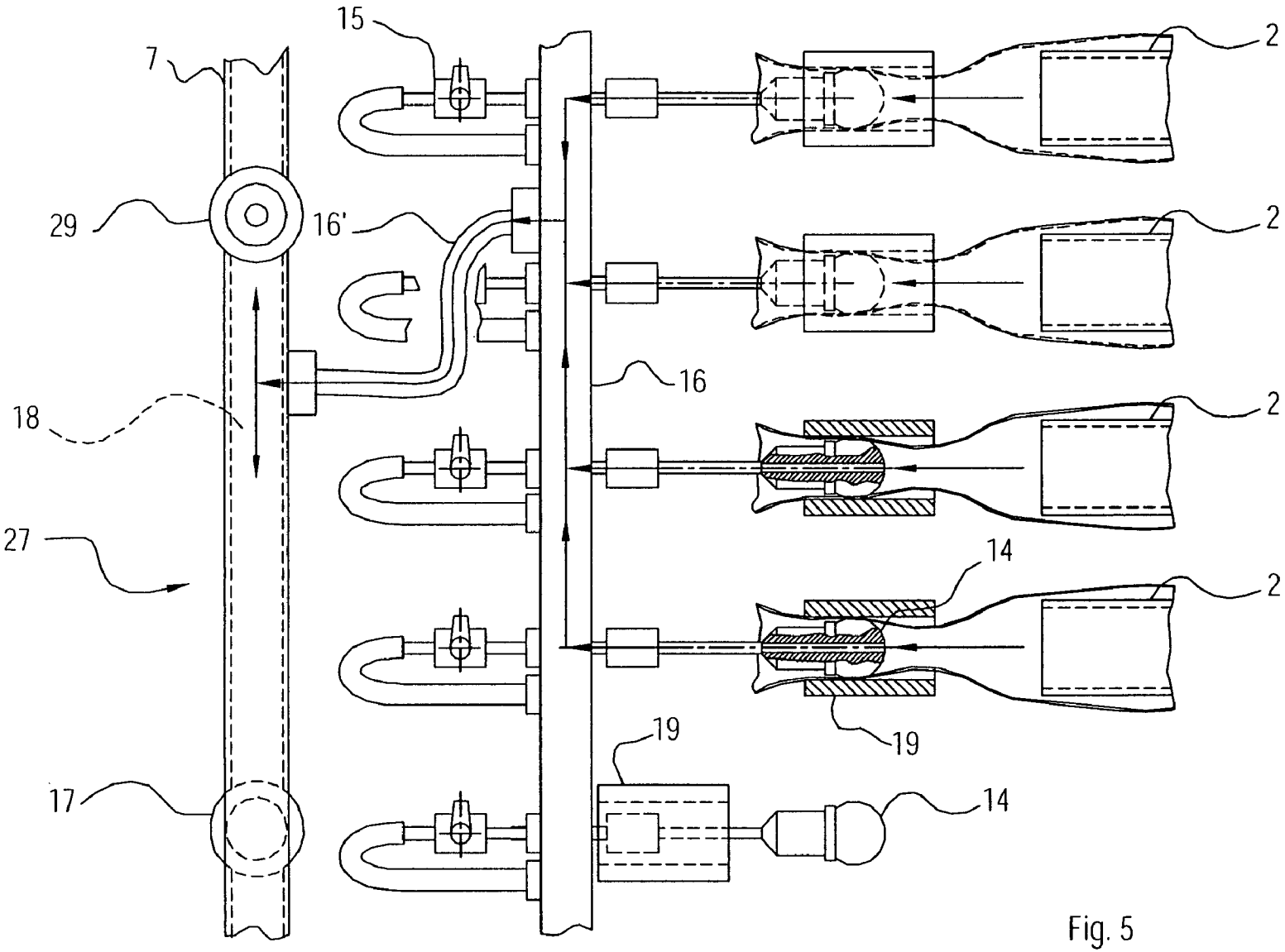
FIG. 5 is a plan view of a detail of one of the apparatuses in FIG. 3.

As shown in detail in FIG. 5, the frame 7 comprises a support structure to which a circuit 27 for a fluid, for example air, is fixed, comprising a connector 14 for each end of each profiled section 2, such connectors 14 being insertable into the open ends of each enclosure to take up air from inside each enclosure wrapping a profiled section 2. Each end of the enclosure is arranged in such a way as to surround the connector 14 against which it can be closed and held in place by a sleeve 19 surrounding the connector 14. The connectors 14 can be taken away from or brought up to the ends of a profiled section 2 to facilitate the insertion of the connector 14 into the enclosure wrapping the profiled section 2, by an adjusting device that are not shown that can be fitted near just one end of the profiled section 2 and not be present at the other end. After the sleeve 19 has been arranged in such a way as to fasten the end of the enclosure, the adjusting device enables the enclosure to be stretched by removing the connector 14 from the relative profiled section 2 in such a way as to eliminate any creases or folds in the enclosure in contact with the profiled section 2.

The circuit 27 for a fluid furthermore comprises flow regulators 15 (FIG. 5) for each connector 14, a manifold 16 that collects the air coming from each connector 14, a connecting pipe 16' that conveys the air as far as a conduit 18, which can be obtained inside a tubular bar forming the support structure of the frame 7. To the tubular bar a second valve 17 is connected arranged to cooperate with the first valve 13 of the carriage 8 to place the inside of the enclosures wrapping the profiled sections 2 in communication with the suction device 26 (FIGS. 3 and 4). The duct 18 is furthermore provided with a third valve 29 (FIG. 5) that enables the frame 7 to be pneumatically connected to an overhead-crane conveyor that will be disclosed below.

Figure 8:
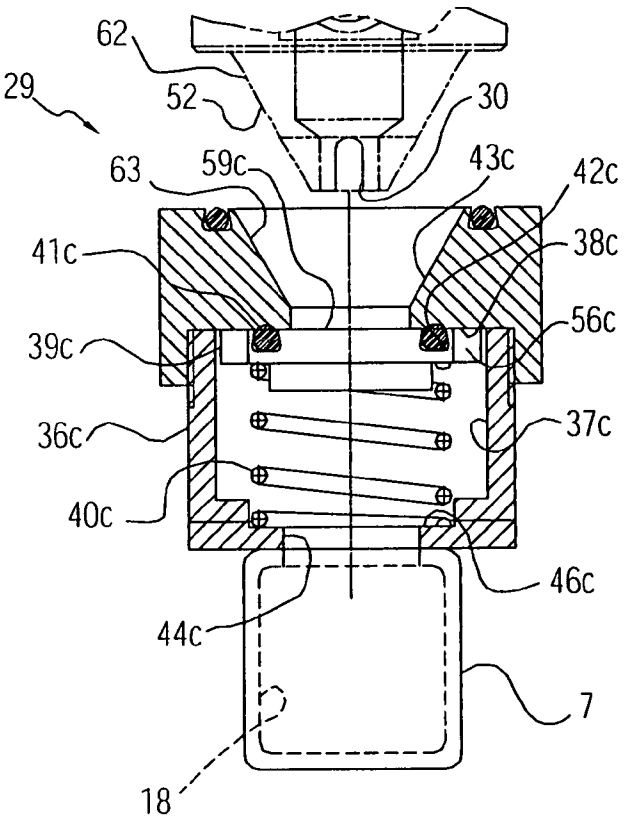
FIGS. 6, 7, 8 are enlarged sections of valve devices provided in the apparatuses of FIG. 3.
Figure 7:
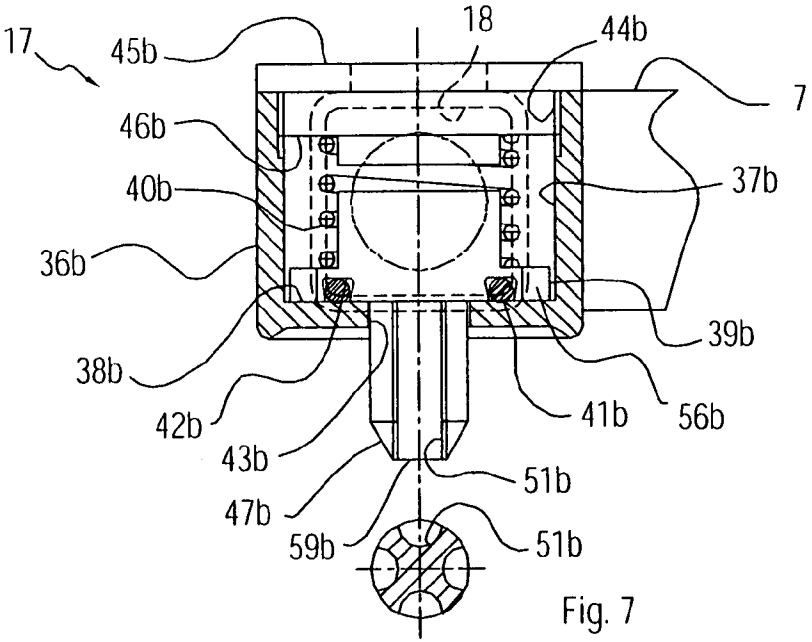
Figure 6:
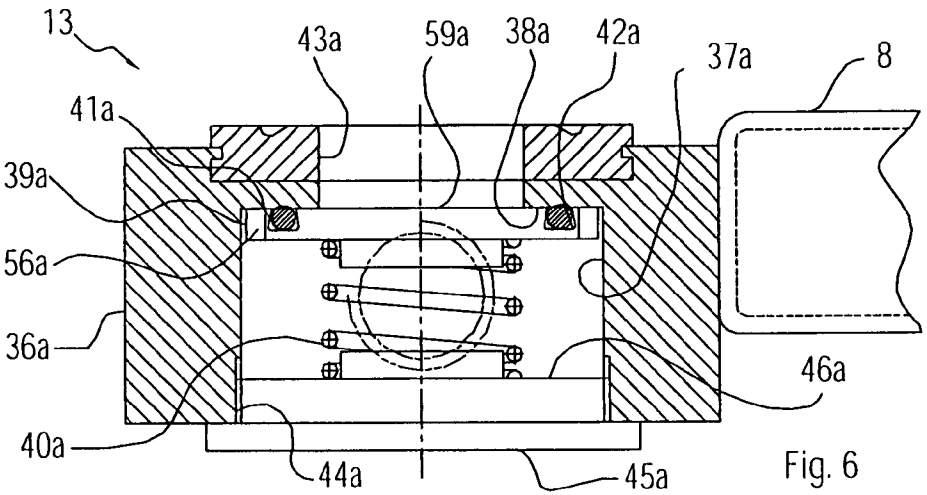

As shown in FIGS. 6, 7 and 8, the valves 13, 17 and 29 are similar to one another and are provided with a cooperating arrangement comprising an activation surface 59*a*, 59*b*, 59*c* provided in a shutter 39*a*, 39*b*, 39*c* with which each valve 13, 17, 29 is supplied.

Each valve 13 (FIG. 6), 17 (FIG. 7), 29 (FIG. 8) furthermore comprises a body 36*a*, 36*b*, 36*c* provided with a through cavity 37*a*, 37*b*, 37*c* that has on one side a hole 43*a*, 43*b*, 43*c* for the passage of a fluid and on the other side a further hole 44*a*, 44*b*, 44*c*. Near the hole 43*a*, 43*b*, 43*c* a shoulder 38*a*, 38*b*, 38*c* is obtained and at the further hole 44*a* a plug 45*a*, 45*b* can be engaged to seal this further hole 44*a*, 44*b* in a substantially hermetic manner. The shutter 39*a*, 39*b*, 39*c*, provided with a seal 41*a*, 41*b*, 41*c*, is pressed against the shoulder 38*a*, 38*b*, 38*c* by a spring 40*a*, 40*b*, 40*c*, for example of the compression type, or by any resilient element, cooperating with a stop surface 46*a*, 46*b*, 46*c* obtained near the further hole 44*a*, 44*b*, 44*c* or near the plug 45*a*. The seal 41*a*, 41*b*, 41*c*, is inserted in a channel 42*a*, 42*b*, 42*c* obtained on one side of the shutter 39*a*, 39*b*, 39*c* intended to face the shoulder 38*a*, 38*b*, 38*c*.

The shutter 39*a*, 39*b*, 39*c* can be peripherally provided with recess zones 56*a*, 56*b*, 56*c*, that identify a passage for the air between an external contour of the shutter 39*a*, 39*b*, 39*c*, and the through cavity 37*a*, 37*b*, 37*c*.

As FIG. 7 shows, the shutter 39*b* of the second valve 13 can be provided with a protruding element 47*b* that projects from the hole 43*b* outside the through cavity 37*b*. The protruding element 47*b* may have a circular section and comprise four recesses 51*b* arranged substantially at 90° to one another, in such a way as to enable the passage of the air, as shown in the section of the protruding element 47*b* of FIG. 7.

As shown in FIG. 8, the hole 43*c* may comprise a centring device including a coupling surface 62 on a presser 52 and a corresponding inner surface 63 of the hole 43*c* provided with a widened V-shaped section, arranged to house the presser 52 in a shapingly coupled manner.

Each valve 13 (FIG. 6), 17 (FIG. 7), 29 (FIG. 8) is shown in a closed configuration in which the passage of a fluid from the inside of each valve 13, 17, 29 to the outside thereof and vice versa is not possible.

When the shutter 39*a*, 39*b*, 39*c* is shifted from the shoulder 38*a*, 38*b*, 38*c* each valve 13, 17, 29 moves to an open configuration in which a fluid may pass through the valve 13, 17, 29.

In particular, the activation surface 59*a* (FIG. 6) of the shutter 39*a* is arranged to cooperate with the activation surface 59*b* (FIG. 7) of the protruding element 47*b*, and the activation surface 59*c* (FIG. 8) of the shutter 39*c* is arranged to be pressed by the presser 52.

Figure 9:
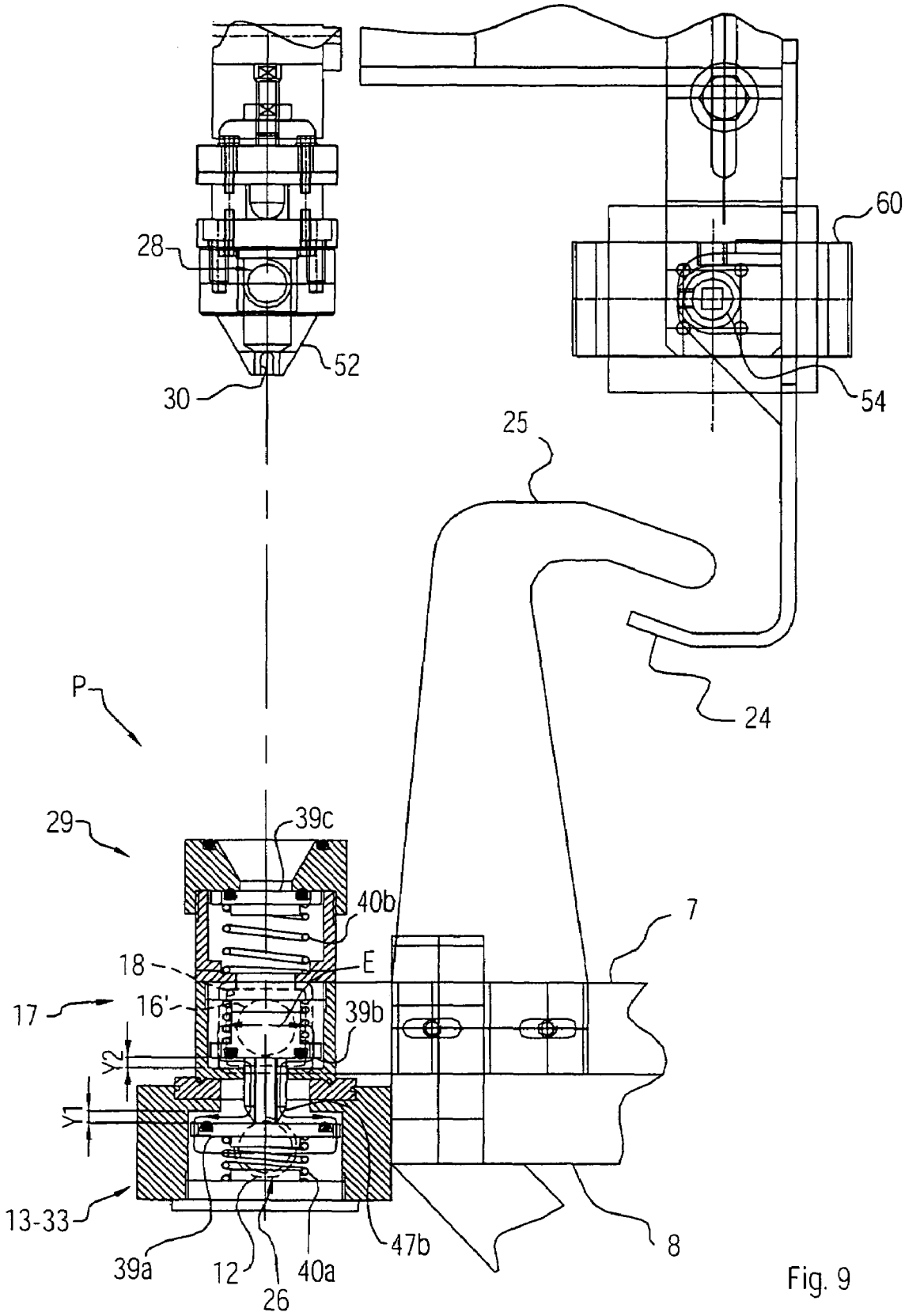
FIG. 9 is a fragmentary and enlarged section taken along the plane IX-IX of FIG. 4, illustrating the apparatuses in FIG. 4 in a preparation configuration.

As shown in FIG. 9, in position A (FIG. 1), the carriage 8 and the frame 7 are in a preparation configuration P, in which the first valve 13 on the carriage 8 cooperates with the second valve 17 on the frame 7, in such a way as to enable the passage of a fluid, for example air, through both the valves 13 and 17 arranged in contact with each other. The protruding element 47*b* of the second valve 17 presses against the shutter 39*a*, with sufficient force to compress the spring 40*a* by a certain length Y1, in such a way as to open the first valve 13. The spring 40*a* is compressed before the spring 40*b*, which is provided with greater stiffness than the spring 40*a*. Subsequently, the spring 40*b* of the second valve 17 is compressed by a length Y2. The shutter 39*b* thus moves away from the shoulder 38*b* and also the second valve 17 is open.

In this way, a first suction phase may occur in which the air contained inside the enclosures, each of which wraps a profiled section 2, is sucked by the vacuum pump 11 (FIG. 3) through the connectors 14 (FIG. 3), passing from the conduit 18 (FIG. 9) through the second valve 17 on the frame 7 and the first valve 13 on the carriage 8, according to a route indicated by the arrows E (FIG. 9). Each enclosure adheres to each profiled section 2 by vacuum.

The frame 7, together with the profiled sections 2 arranged on it, is then removed from position A (FIG. 1), shifting the corresponding carriage 8 onto the guides 10 to position B in the transit station 4 (FIG. 1). The first suction phase may also continue even when the carriage 8 is moving as the suction device 26 (FIGS. 3 and 4), in particular the vacuum pump 11, is fitted on the carriage 8.

In the transit station 4 (FIG. 1), a further apparatus is provided comprising a conveying device, for example an overhead-crane conveyor 20, which is slidable along a beam 21 above the carriages 8 when arranged in the transit station 4, and is movable inside the transit station between the position B and a position C in the interaction station 5, according to a direction indicted by the arrows Q in FIG. 1. The overhead-crane conveyor 20 (FIG. 2), actuated by a drive device 53, is provided with a motor-driven lifting device 22 that supports a hooking structure 23 arranged to hook a frame 7. The hooking structure 23 comprises 'L-shaped' hooks 24 (FIG. 3) that are such as to engage in respective hook members 25 fixed on sides of each frame 7. The number of hook members 25 corresponds to the number of hooks 24 and can for example be provided with six hook members for each frame 7. The hooks 24 are rotatable around a pivot 54 between a lowered position, in which the hooks can hook the hook members 25, and a raised position in which the hooks 24 cannot interact with the hook members 25, the hooks 24 being actuated to rotate by a pneumatic actuator 60 (FIGS. 3 and 4), arranged at an end of the hooking structure 23 near the hooks 24. The hooks 24 are in a raised position in particular when the overhead-crane conveyor 20 moves on the beam 21 (FIG. 2), in such a way as not to interfere with protruding parts of the carriages 8 or of the profiled sections 2 and with other elements protruding towards the hooking structure 23.

The overhead-crane conveyor 20 furthermore comprises a further suction device 28 (FIGS. 3 and 4) that enables air to be sucked from the enclosures of each profiled section 2 even when the frame 7, loaded with profiled sections 2, is moved between the position B (FIG. 1) and the position C (FIG. 1) in the interaction station 5. Such further suction device 28 comprises an aspirator, which is not shown, that is electrically actuatable and electronically controlled, a set of pipes and filters forming a defined path for the air, and a port 30, that protrudes from the hooking structure 23 to the frame 7, through which it is possible to suck air.

The port 30 (FIG. 9) is obtained in the presser 52 comprised in the further suction device 28 and is intended to cooperate with the third valve 29 in order to open said third valve 29 to enable the passage of air between the conduit 18 and the further suction device 28.

In position B (FIG. 2), whilst the frame 7 is still resting on the carriage 8, the hooking structure 23 is lowered by the lifting device 22 and thus brought nearer to the carriage 8. The port 30 is brought up to the third valve 29 by an actuator 31 (FIG. 3) fitted on the hooking structure 23, until it interacts with the third valve 29 and thus takes on an exchange configuration S.

Figure 12:
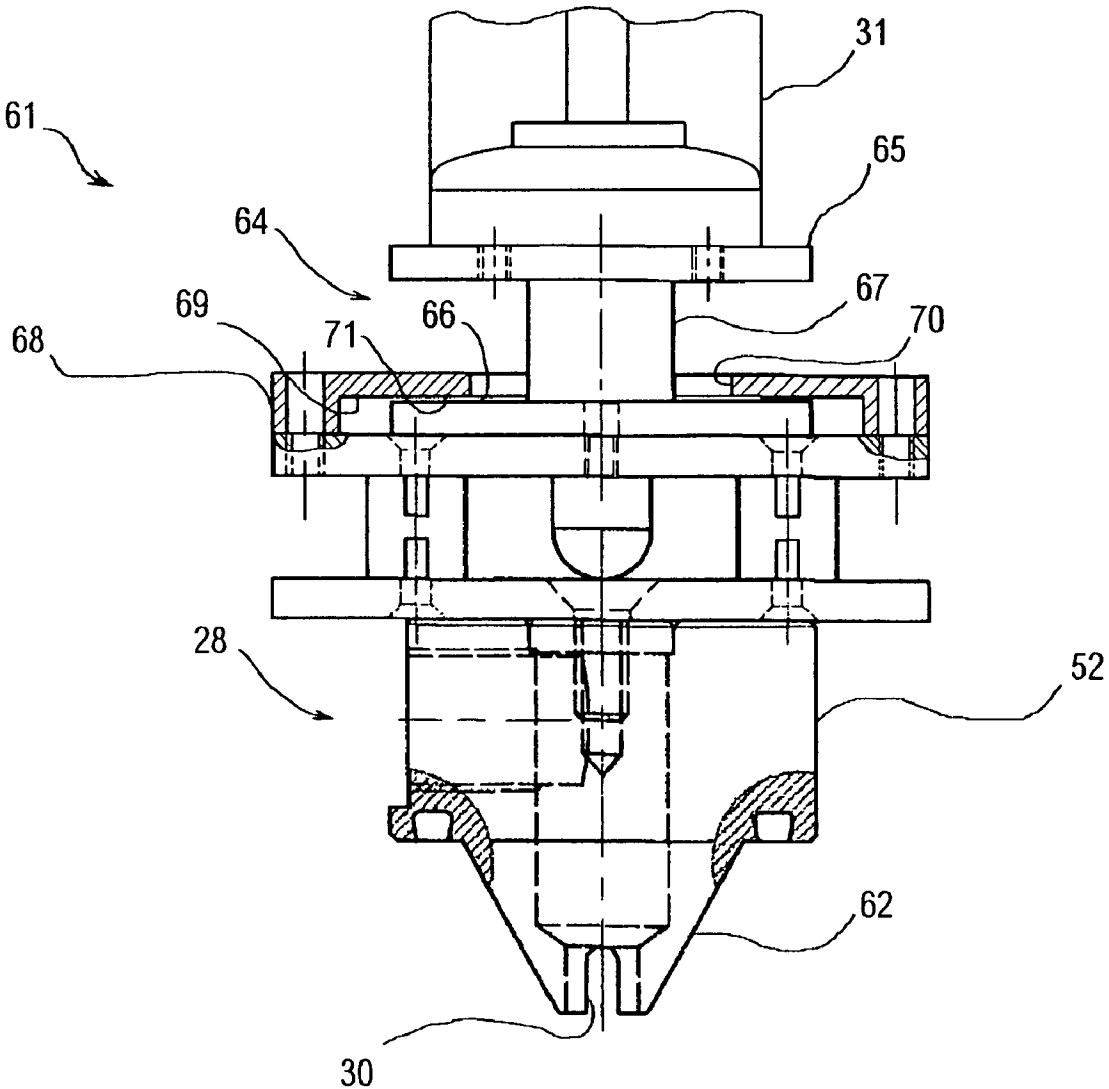
FIG. 12 is an enlarged detail of the apparatus in FIG. 9 illustrating a position setting device provided in the apparatus.

FIG. 12 shows an embodiment of the further suction device 28 in which the presser 52 is equipped with a position setting device 61 arranged to enable the port 30 to be correctly positioned in the hole 43*c* of the third valve 29.

As described above, the presser 52 is positioned on the third valve 29 by the hooking structure 23 which is moved by the over head-crane conveyor 20. As the hooking structure 23 is led over a frame 7, the port 30 could reach a position over the third valve 29 in which the port 30 and the hole 43*c* are not sufficiently aligned to couple correctly when the port 30 is lowered by the actuator 31. Furthermore, a coupling surface 62 on the presser 52 and a corresponding inner surface 63 of the hole 43*c*, intended to shapingly couple to the coupling surface 62 could have not been worked precisely.

The position setting device 61 comprises a reel-shaped member 64 provided with a first plate 65, with which the reel-shaped member 64 is fixed to the steam of the actuator 31, a second plate 66 through which the reel-shaped member 64 is constrained to an anchor plate 68 assembled to the presser 52 and a cylindrical body 67 connected at an end to the first plate 65 and at an opposite end to the second plate 66.

The second plate 66 is engaged in a seat 69 obtained in the anchor plate 68 and the cylindrical body 67 protrudes through a further opening 70 obtained in a wall 71 of the anchor plate 68. The anchor plate 68 together with the presser 52 are movable in any direction on a plane substantially parallel to the second plate 66. The diameter of the second plate 66 is smaller than the diameter of the seat 69 and the diameter of the further opening 70 is larger than the diameter of the cylindrical body 67. The wall 71 prevents the anchor plate 68 from shifting in a direction which is substantially at right angles to the second plate 66. As the first plate 65 is fixed to the actuator 31, the presser 52 may be aligned correctly to the third valve 29 by sliding the anchor plate 68 on the reel-shaped member 64.

Each time the port 30 is lowered to reach the third valve 29 the position setting device 61 may be actuated, in particular by an operator, to set the position of the port 30 in such a way that the coupling surface 62 and the inner surface 63 correctly couples despite incorrect alignment or working tolerances.

The position setting device 61 may be provided in a presser element different from the presser 52. Furthermore, the position setting device 61 may be associated to a valve device to adjust the position of the valve device in relation to the position of a presser element so as to correctly couple each other to enable to open or close the valve device. The valve device to which the position setting device 61 may be associated may have a different structure from that of the above or hereinafter described valves.

Figure 10:
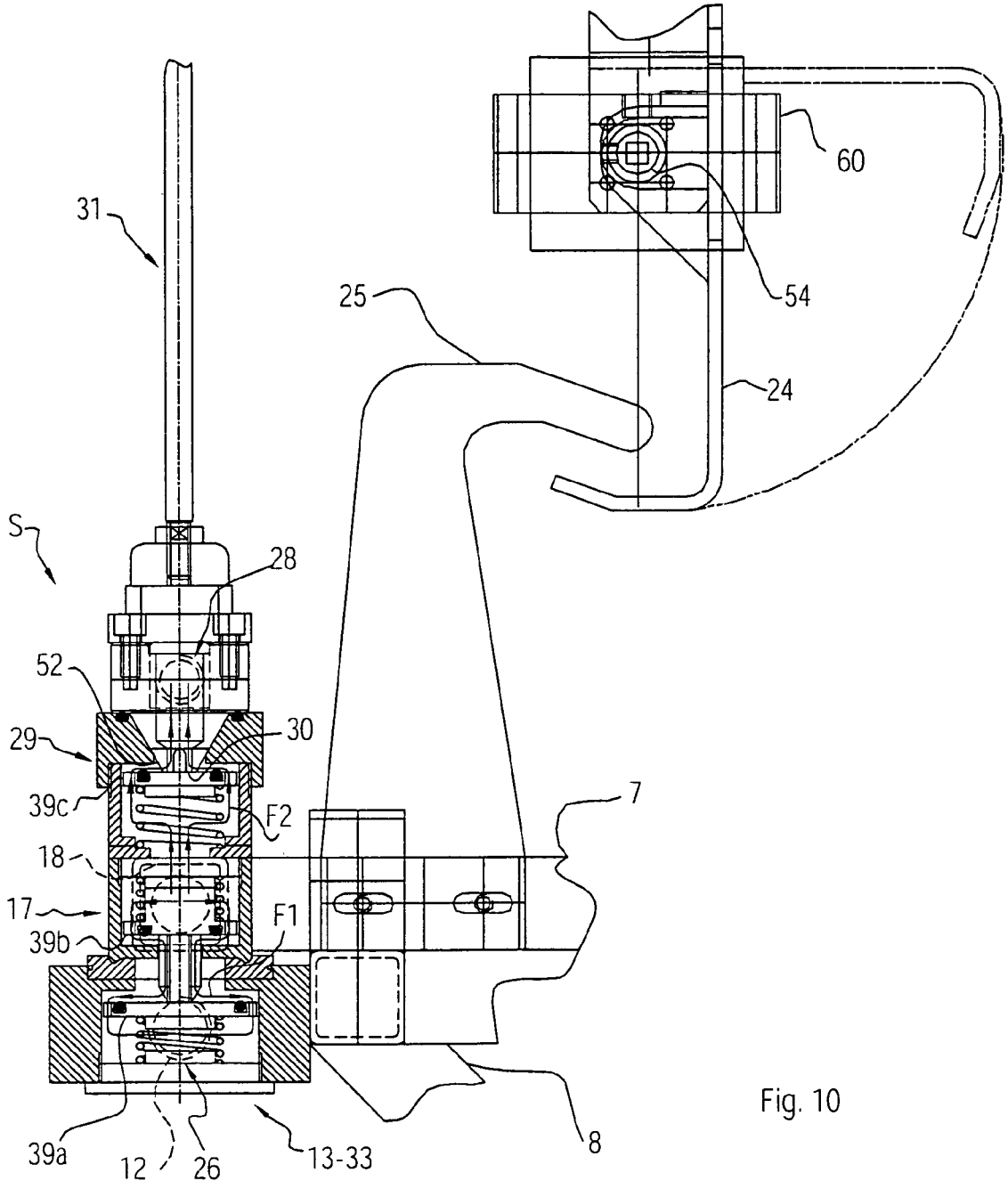
FIG. 10 is a section like the one in FIG. 9 illustrating the apparatuses in FIG. 4 in an exchange configuration.

In FIG. 10, in the exchange configuration S, the presser 52 presses against the shutter 39*c* and thus actuates the shutter 39*c* of the third valve 29, so that the third valve 29 takes on an open configuration. The third valve 29, the second valve 17 and the first valve 13 are thus simultaneously in an open configuration and the air present in the conduit 18 of the frame 7 is sucked both by the suction device 26 on the carriage 8 and by the further suction device 28 on the overhead-crane conveyor 20, following two paths indicated by the arrows F1 and F2.

The hooks 24 are rotated and taken to the lower position to hook the hook members 25, the frame 7 can thus be lifted from the carriage 8 by the lifting device 22 (FIG. 2).

Figure 11:
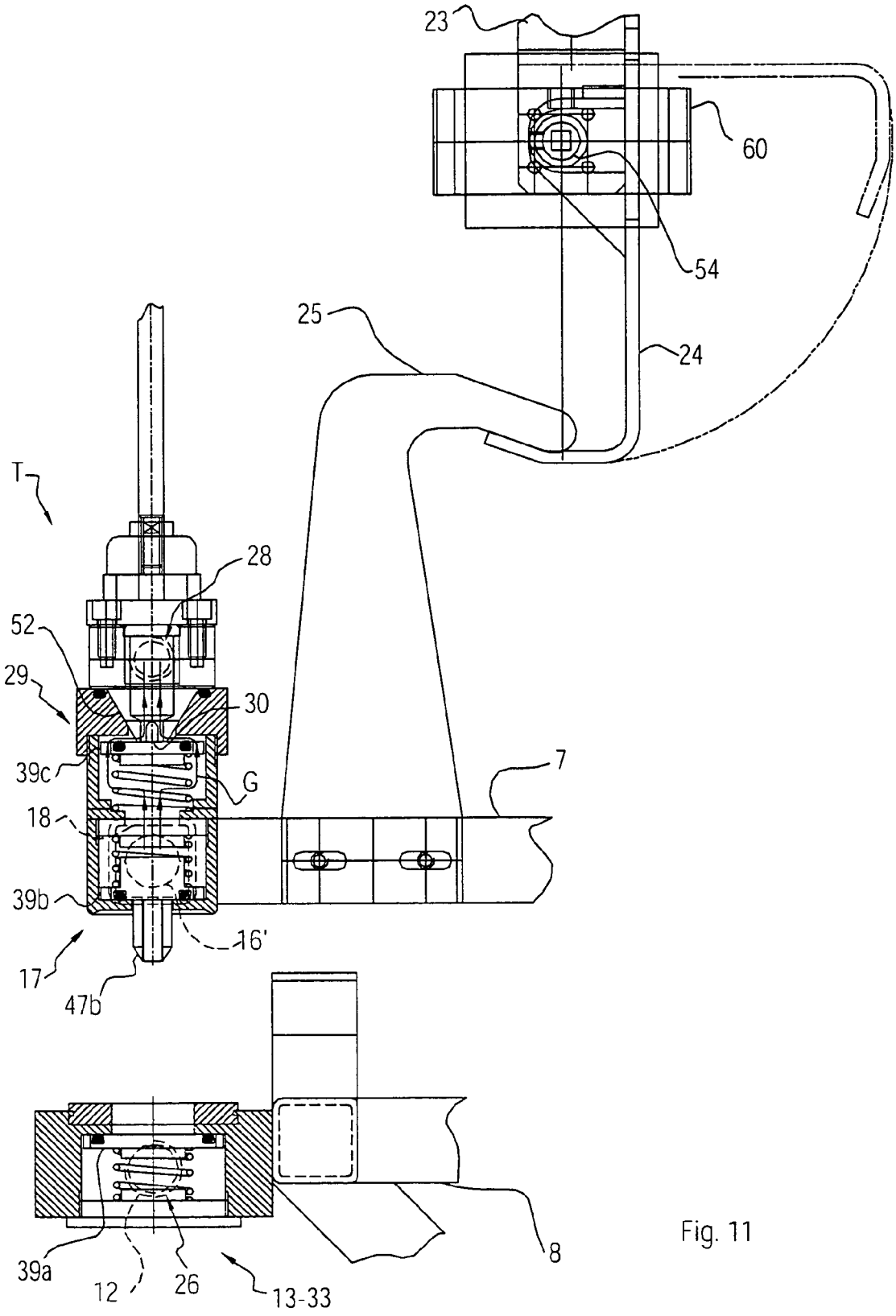
FIG. 11 is a section like the one in FIG. 9 showing the apparatuses in FIG. 4 in the conveying configuration.

In FIG. 11, the second valve 17 is then moved away from the first valve 13, the shutters 39*a* and 39*b* are respectively deactivated and the two valves 13 and 17 take on a closed configuration, in which the passage of air through the valves is inhibited. Only the third valve 29 therefore remains open. The frame 7, hooked onto the hooking structure 23 and lifted up by the lifting device 22 (FIG. 2), can be moved away from position B (FIG. 1), by the overhead-crane conveyor 20, and be taken to the interaction station 5 through the transit station 4. During this shift a second suction phase occurs, in which air is sucked from inside the enclosures wrapping all the profiled sections 2 present on the frame 7 through the connectors 14 (FIG. 5) the conduit 18 (FIG. 11), the third valve 29 and the port 30 of the further suction device 28 on the overhead-crane conveyor 20. This second suction phase requires greatly reduced suction power inasmuch as the second suction phase is required only to maintain the degree of vacuum already reached inside the enclosures during the first suction phase.

Suction thus proceeds without interruption between the first suction phase and the second suction phase.

In the meantime another frame, arranged on another carriage in the preparation station 3 (FIG. 1), can be prepared by loading upon it new profiled sections to be decorated.

Once the frame 7 has reached the interaction station 5 (FIG. 2), the lifting device 22 lowers and the frame 7 is taken to position C, in which it is rested against a sliding support 32 arranged in the interaction station 5 and slidable between the interaction station 5 and the oven 9 according to a direction identified by the arrows V in FIG. 1 or in FIG. 2. The sliding support 32 is connected to a further circuit for a fluid that is not shown, comprising a pneumatic operating system able to suck or blow a fluid, for example air, pipes defining a path for the fluid and a fourth valve 33 (FIG. 2) which, through a relative shutter, is actuated to open when the frame 7 is in position C.

The fourth valve 33 on the sliding support 32 is structurally and functionally shaped like the first valve 13 on the carriage 8.

In position C, the frame 7 again takes on an exchange configuration S, inasmuch as the second valve 17 on the frame 7 is actuated to open together with the fourth valve 33 in a manner similar to the manner described previously for such an exchange configuration S. For this reason, the fourth valve 33, fixed on the sliding support 32, the second valve 17 and the third valve 29 are simultaneously in open configuration and the air in the conduit 18 of the frame 7 can be sucked both by the further suction device 28 on the overhead-crane conveyor 20, through the third valve 29, and by the pneumatic operating system of the further circuit for a fluid, through the second valve 17 connected to the fourth valve 33.

Subsequently, the hooking structure 23 unhooks and being supported by the lifting device 22 moves away from the frame 7. The port 30 (FIG. 9), controlled by the actuator 31, is moved away from the third valve 39 in such a way that the shutter 39*c* of the third valve 29 closes the third valve 29. The frame 7 then takes on a similar configuration to the preparation configuration P, in which the air present in the conduit 18 is sucked only by the further circuit for a fluid through the second valve 17 connected to the fourth valve 33. The sliding support 32 (FIG. 2) then conveys the frame 7 from the interaction station 5 to inside the oven 9, in which the transfer of the decorative pattern from the sheet wrapped as an enclosure to each profiled section 2 takes place. Through the fourth valve 33 a certain vacuum is thus maintained inside all the enclosures that simultaneously engage the frame 7 even during sublimation. In this way it is prevented that the residual air inside the enclosures detaches the enclosure from the profiled section 2 by expanding through the effect of heating, causing imperfections in the decoration due to lack of adherence of the enclosures to the profiled sections 2.

During sublimation, a remote temperature gauge 35 (FIG. 2), for example a laser thermometer, positioned outside the oven 9 at an opening 34 arranged on a side 55 of the oven 9, detects the temperature on the profiled section 2 which, inside the oven 9, occupies a region that faces the opening 34. To ensure that the temperature gauge 35 effectively detects the temperature during the sublimation phase, the frame 7 is provided with positioning elements that are not shown that are arranged to correctly position the profiled section 2 on the frame 7, the profiled section 2 being intended to engage the region facing the opening 34. To enable correct measuring of the temperature by the gauge 35, a profiled section 2 must always be placed on the frame 7 at the positioning elements, even if the frame 7 is not completely loaded with profiled sections 2. Owing to the temperature gauge 35, it is not necessary to attach and/or detach any temperature probe to a specific profiled section 2, which enables the operations of loading and unloading of the profiled sections 2 from the oven 9 to be simplified.

At the end of the sublimation phase, the frame 7 is returned to position C by the sliding support 32 and through the fourth valve 33 the pneumatic operating system blows air inside each enclosure in such a way as to facilitate detachment of the enclosure from the profiled section 2 once the decorative pattern has already been transferred to the profiled section 2. During this phase, the flow of blown air is reversed in relation to the flow of sucked air, and the air follows the same path but in the opposite direction to the arrows E of FIG. 9, going through the fourth valve 33 and the second valve 17.

The hooking structure 23 (FIG. 2) is lowered by the lifting device 22 to hook the frame 7 loaded with the profiled sections 2 that are already decorated and still wrapped in the used enclosure and remove it from the sliding support 32. The frame 7 again takes on the exchange configuration S (FIG. 10) and subsequently, when lifted up from the sliding support 32, the conveying configuration T (FIG. 11). In the exchange configuration S (FIG. 10) the third valve 29 is opened and then crossed by blowing air coming from the port 30. The further suction device 28 on the overhead-crane conveyor 20 can in fact also be actuated to blow air or alternatively, the overhead-crane conveyor 20 can be equipped with a blowing device that sends air through the port 30.

Furthermore, when the frame 7 takes on the conveying configuration T (FIG. 11), the fourth valve 33 closes.

The frame 7 is lifted up and taken to the transit station 4 to be rested on a carriage 8 arranged there, thereby again taking on an exchange configuration S (FIG. 10). Subsequently, the frame 7 takes on a preparation configuration P (FIG. 9), in which air is blown from the carriage 8. In fact, the suction device 26 with which the carriage 8 is provided can be shaped in such a way as to also perform a blowing function in addition to an air-suction function.

The overhead-crane conveyor 20 can then move near another carriage arranged in the transit station 4 and supporting a frame loaded with profiled sections that has been previously prepared and is ready to be conveyed as far as the oven 9.

The carriage 8, together with the frame 7 provided with decorated profiled sections that are still wrapped in the used enclosures, is moved along the guides 10 to the preparation station 3, where the already decorated profiled sections 2 are unloaded from the carriage 8, which can be used again for loading other profiled sections to be decorated. The cycle of operations disclosed above can thus be repeated.

The time that elapses between the moment in which the frame 7 loaded with profiled sections 2 is unloaded from the oven 9 and the moment in which the frame 7 again reaches the preparation station 3 is sufficient to enable the frame 7 to cool in such a way as to reduce the risk of burns for operators entrusted with unloading the already decorated profiled sections 2.

In the embodiment in FIGS. 1 and 2, one of the carriages 8 is dedicated to unloading the profiled sections 2, whilst the other two carriages, in particular those nearer the sublimation station 6, are intended to loading and preparing the profiled sections 2.

The number of carriages 8 and frames 7 can be selected according to the output that one wishes to obtain.

Owing to the apparatus 1, it is possible to achieve greater productive capacity inasmuch as production time is no longer affected by the time required to set up each carriage with the profiled sections to be decorated. Furthermore, it is possible to significantly increase the degree of automation of the productive process for objects decorated by transfer of images from a support sheet.

The invention claimed is:

1. Apparatus for decorating objects, comprising:

a support arrangement including a frame for supporting said objects wrapped in respective enclosures, each enclosure being made from a sheet carrying a sublimable decoration, said frame having a plurality of connectors for sucking air from inside each enclosure through a circuit;

a valve device fixed to said support arrangement and provided with a shutter element actuatable for opening or closing said circuit;

a heating device for heating said objects so that said sublimable decoration is transferred from each enclosure to the respective object; and a conveying device which can be removably coupled to said frame for conveying said frame towards said heating device;

wherein said shutter element is such as to be actuated when said frame is coupled to said conveying device in order to keep each enclosure adherent to the respective object by suction during said conveying.

2. Apparatus according to claim 1, wherein said shutter element is further actuated when said frame is coupled to a carriage of said support arrangement on which said frame can be removably positioned.

3. Apparatus according to claim 2, wherein said shutter element is further actuated when said frame is coupled to a movement device associated with said heating device for moving said frame inside and outside said heating device.

4. Apparatus according to claim 3, wherein said valve device comprises a first cooperating arrangement and a second cooperating arrangement arranged to interact in such a way as to open said valve device.

5. Apparatus according to claim 4, wherein said first cooperating arrangement is arranged on said frame.

6. Apparatus according to claim 5, wherein said second cooperating arrangement is arranged on said conveying device.

7. Apparatus according to claim 5, wherein said second cooperating arrangement is arranged on said carriage.

8. Apparatus according to claim 5, wherein said second cooperating arrangement is arranged on said movement device.

9. Apparatus according to claim 4, wherein said first cooperating arrangement comprises a protruding element that extends from said shutter element outside said valve device, and said second cooperating arrangement comprises a housing element arranged to receive said protruding element.

10. Apparatus according to claim 9, wherein said shutter element cooperates in a substantially fluid-tight manner with a shoulder, obtained in said valve device, to close a path of said air through said housing element, in such a way as branches of said circuit, that are arranged on opposite sides of said valve device, are separate.

11. Apparatus according to claim 10, wherein said valve device comprises a resilient element interposed between said shutter element and a stop surface, provided inside said valve device, said resilient element pressing said shutter element against said shoulder.

12. Apparatus according to claim 11, wherein said shutter element is peripherally provided with recess zones, arranged in such a way as to identify a passage for said air between an external contour of said shutter element and a wall of said valve device.

13. Apparatus according to claim 9, wherein said housing element comprises a centring device such as to enable said protruding element to be positioned correctly in said housing element.

14. Apparatus according to claim 9, and further comprising a pneumatic operating system arranged to suck or blow said air through said valve device.

15. Apparatus according to claim 14, wherein said pneumatic operating system comprises a suction and blowing device fixed to said conveying device.

16. Apparatus according to claim 15, wherein said pneumatic operating system comprises a further suction and blowing device fixed to said carriage.

17. Apparatus according to claim 16, wherein said pneumatic operating system comprises a still further suction and blowing device fixed to said movement device.

18. Apparatus according to claim 17, wherein said valve device comprises a first valve fixed to said carriage and furthermore connected to said further suction and blowing device.

19. Apparatus according to claim 18, wherein said valve device comprises a second valve fixed to said frame and arranged to be coupled with said first valve.

20. Apparatus according to claim 19, wherein said valve device comprises a third valve fixed to said frame and arranged to be coupled with a port member provided in said conveying device.

21. Apparatus according to claim 20, wherein said port member is connected to said suction and blowing device.

22. Apparatus according to claim 21, wherein said valve device comprises a fourth valve fixed to said movement device arranged to be coupled with said second valve and furthermore connected to said still further suction and blowing device.

23. Apparatus according to claim 20, wherein said second valve and said third valve are connected to said plurality of connectors arranged on said frame, each connector being intended to be inserted into a respective open end of said enclosures and close said open end.

24. Apparatus according to claim 1, wherein said frame is provided with a hooking element so that said conveying device can hook said frame to shift it.

25. Apparatus according to claim 3, wherein said conveying device is provided with a drive device arranged to shift said conveying device between a plurality of workstations for said objects.

26. Apparatus according to claim 25, wherein said carriage is movable between a preparation station, in which said objects are loaded onto said frame supported by said carriage and a transit station, in which said frame interacts with said conveying device.

27. Apparatus according to claim 26, wherein said carriage is actuated by a further drive device.

28. Apparatus according to claim 26, wherein said conveying device is movable between said transit station and an interaction station in which said frame interacts with said movement device.

29. Apparatus according to claim 28, wherein said movement device is actuated by a still further drive device to move between the inside and the outside of said heating device.

30. Apparatus according to claim 1, wherein said conveying device comprises an overhead-crane conveyor.

31. Apparatus according to claim 1, wherein said frame is provided with a positioning element so configured as to enable to position said objects on said frame in a reference position arranged near a peripheral edge of said frame.

32. Apparatus according to claim 1, wherein said heating device is provided with a remote temperature gauge device arranged to measure the temperature of said objects in a reference position near a peripheral edge of said frame.

33. Apparatus according to claim 32, wherein said remote temperature gauge device comprises a laser thermometer device.

* * * * *